US005842896A

United States Patent [19]

Liveoak

[11] Patent Number: 5,842,896

[45] Date of Patent: Dec. 1, 1998

[54] HAND OPERATED PADDLE

[76] Inventor: Talmadge W. Liveoak, 501 Brentwood Dr., Madison, Ala. 35758

[21] Appl. No.: 359,562

[22] Filed: Dec. 20, 1994

Related U.S. Application Data

[63] Continuation-in-part of Ser. No. 12,296, Aug. 30, 1993, Pat. No. Des. 353,573.

[51] Int. Cl.[6] ..... A63B 31/10

[52] U.S. Cl. ..... 441/56; 440/101

[58] Field of Search ..... 440/101; 441/55, 441/56, 58; 416/70 R; D12/215; D21/239

[56] References Cited

U.S. PATENT DOCUMENTS

| | | | |
|---|---|---|---|
| 216,455 | 10/1879 | Primbs | 441/58 |
| 2,109,429 | 2/1938 | Malm | 441/56 |
| 2,745,119 | 5/1956 | Whipple | 441/56 |
| 3,039,120 | 6/1962 | Powell et al. | 441/56 |
| 3,529,313 | 9/1970 | Girden | 441/58 |
| 4,233,925 | 11/1980 | Proctor | 440/101 |
| 4,493,663 | 1/1985 | Richmond | 440/101 |

*Primary Examiner*—Sherman Basinger
*Attorney, Agent, or Firm*—Mark Clodfelter

[57] ABSTRACT

A paddle for use with a hand and forearm of a user is provided. The paddle has a paddle blade of a length shorter than its width, and generally encompasses an area approximating the span of the hand of a user. A support which provides support for the wrist extends from the paddle blade to a point near a user's elbow, with an opening in the support through which a user inserts a hand. A cover surrounds the hand and secures the paddle blade to the user's hand. As such, the user may rest an opened hand against the blade while using the paddle.

15 Claims, 3 Drawing Sheets

HAND OPERATED PADDLE

CROSS REFERENCE TO RELATED APPLICATION

This application is a continuation-in-part of patent application Ser. No. 29/012,296, filed Aug. 30, 1993, now U.S. Pat. No. D353,573, issued Dec. 20, 1994.

FIELD OF THE INVENTION

This invention relates generally to hand held boat paddles, and particularly to a hand paddle for use primarily with a small, shallow draft recreational boat, such as a kayak.

BACKGROUND OF THE INVENTION

Hand paddles of the prior art are known to the Applicant. For instance, U.S. Pat. No. 4,233,925, issued Nov. 18, 1980, to Proctor, discloses a hand operated paddle having a paddle blade which is much longer than its width, so that a user need not wet his/her hand or arm during use by only dipping a portion of the paddle blade into the water. Stiffening regions normal to the plane of the paddle blade are formed along both sides thereof, and provide rigidity to the paddle blade. A first aperture for receiving fingers of the user when the paddle is gripped is provided toward an end of the paddle that is handled by the user, which first aperture being relatively narrow and oriented laterally in the body of the paddle. A second, larger aperture is positioned outboard the first aperture, with the end of the paddle adjacent the second aperture configured as a concave brace that bears against the lower forearm or wrist region of the user. A generally elongated grip lateral to the paddle is thus formed between the first and second apertures, enabling the user to grip the paddle.

Initially, the paddle of the reference to Proctor is not suitable for use in conjunction with a kayak due to the paddle being much too long and cumbersome. As such, due to the small size of a kayak and close proximity of the user to the water, a kayak user having the paddle of Proctor has little choice but to use the entire length of the paddle, which quickly tires the user. Exacerbating this problem is the close proximity of the brace to the wrist of the user, meaning that the small distance between the brace and handgrip provides insufficient leverage to effectively operate the paddle of Proctor and places undue strain on the wrist and hand of the user. Additionally, the length of the paddle of Proctor is such that it could easily strike the bottom of a shallow, fast-moving water channel, such as rapids, presenting a danger of injury to the user and damage to the rigid paddle. Further, the paddle of Proctor is usable in only one orientation. Further yet, since it is intended that only a portion of the paddle blade of Proctor is to be used during paddling, no provision is made to thermally insulate or physically protect the hand of the user.

U.S. Pat. No. 4,493,663, issued Jan. 15, 1985, to Richmond, is of similar construction to the reference of Proctor. Thus, the reference of Richmond discloses a hand held paddle having a paddle blade of much greater length than its width, which will tire or exhaust a user and strain the wrist after a short period of time, as described in the foregoing. Reinforcing ridges integral with the paddle are formed on both side edges thereof, which ridges extending longitudinally along the length of the paddle to provide rigidity. A first aperture of relatively narrow configuration for receiving fingers of the user is centrally positioned therein, this first aperture extending laterally in the paddle.

A second larger aperture is positioned in the paddle near an end opposite the paddle blade, with the end wall of the aperture configured as a concave brace for bearing against the wrist region of the user, similar to the brace shown in the reference of Proctor. However, unlike the reference to Proctor, this brace is provided with a foam gripping member so as to engage and grip the wrist region of the user and to physically protect the wrist from pressure of the brace. Like the reference to Proctor, the first and second apertures form a grip therebetween so as to enable the paddle to be gripped by the user.

Constructed as described, the paddle to Richmond is also usable only in only one orientation, and is too long for any extended use with a kayak. As with the paddle of Proctor, there is no disclosure in Richmond of any means to thermally insulate or physically protect the hand of the user. Additionally, since the paddles of both Richmond and Proctor are rigid, inadvertent striking of obstacles with the paddle, such as a rock or the bottom of a water channel, may cause injury to the user and damage the paddle. In this latter instance, there is a particular danger that if one paddle becomes damaged to the point of uselessness, the user loses effective control of the kayak, which could be disastrous in shallow, fast-moving water.

In accordance with the foregoing, it is therefore an object of the invention to provide a hand held paddle having a paddle blade which is shorter in length than its width, and which is reversible to provide two different types of paddling configurations. It is a further object of the invention to provide a boat paddle that offers a measure of thermal insulation and physical protection for the users hand, and which also functions to secure the paddle to the users hand, reducing or eliminating the need for the user to grip the paddle.

DETAILED DESCRIPTION OF THE DRAWINGS

Figure 1:
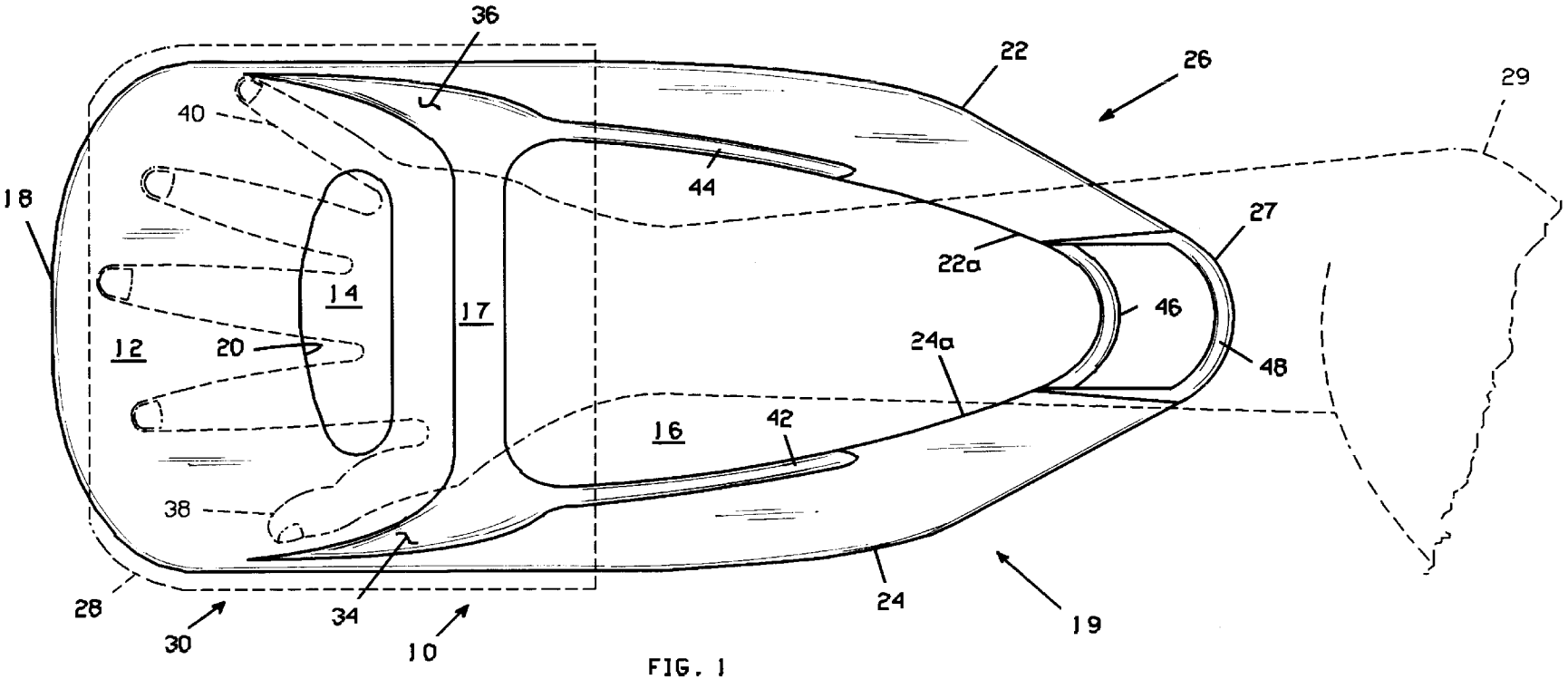
FIG. 1 is a top view of a paddle of the instant invention showing details of construction thereof and dashed line representations of relative positions of a user's hand and a cover as they would appear one mode of use.

Referring initially to FIG. 1, a boat paddle 10 having a paddle blade 12 and first and second apertures 14 and 16, respectively, for use with one hand and arm of an individual is shown. Paddle 10 may be constructed of any relatively flexible material, such as a co-polymer polypropylene product No. FF3BOAK, available from REPLAS Inc. of Evansville, Ind. Constructed of this material, paddle 10 flexes similarly to fins worn on the feet of scuba divers when moved through the water. As such, if a rock or obstacle in the water is struck by the paddle, injury to the user is less likely to occur due to flexure of the paddle, which absorbs force of the impact. Additionally, the likelihood of striking an object in or under water is reduced due to blade 12 being dimensioned such that its length is shorter than the width of the paddle. As such, while paddling a kayak, the paddle blade extends into the water generally no further than the reach of the individual operating the kayak. The short length of blade 12 is also significant inasmuch as it has been found that a paddle having a significantly longer blade or surface area than that of the instant invention cannot feasably be used for an extended length of time without straining or exhausting the user. While these proportions may vary, a paddle blade width of about 7 inches and a length of about 3 inches as measured from end 18 of blade 12 to edge 20 of aperture 14 has been found to be dimensions that are within strength and endurance capabilities of kayaking enthusiasts without causing the aforementioned stress, exhaustion, or other discomfort, while at the same time providing an enhanced safety factor with respect to striking obstacles in the water. Additionally, since the aforementioned co-polymer polypropylene has a specific gravity of about 0.9, the paddles float, making them less likely to become lost if separated from the user.

With this short paddle blade 12, the first aperture 14 is positioned as shown closer to edge 18 of paddle blade 12, with the second aperture 16 defined by a support region 19 having converging supports 22 and 24 that terminate at a reinforced end region 26, which generally bears as shown against the upper forearm near elbow 29 of the user. However, during maneuvering and rapid paddling, such as when traversing a difficult section of rapids, regions 22*a* and 24*a* of supports 22 and 24, respectively, may temporarily be brought to bear against the upper forearm due to rapid maneuvering of the paddles as the user endeavors to maintain directional control and an upright posture of the kayak.

The region between apertures 14 and 16 define a handgrip 17, which may be gripped by the user if so desired. Here, a user inserts his/her hand through aperture 16 and grips handgrip 17, with fingers of the user extending through aperture 14. Significantly, a user may insert his/her hand through aperture 16 from either side of the paddle in order to use the paddle, as will be further described.

A cover 28 (dashed lines in FIG. 1) may be fitted generally over blade 12 and a portion of aperture 16, and allows another mode of use where the user does not hold grip 17, but simply extends his/her hand against paddle blade 12, as shown in FIG. 1 and as will also be described hereinafter.

Figure 2:
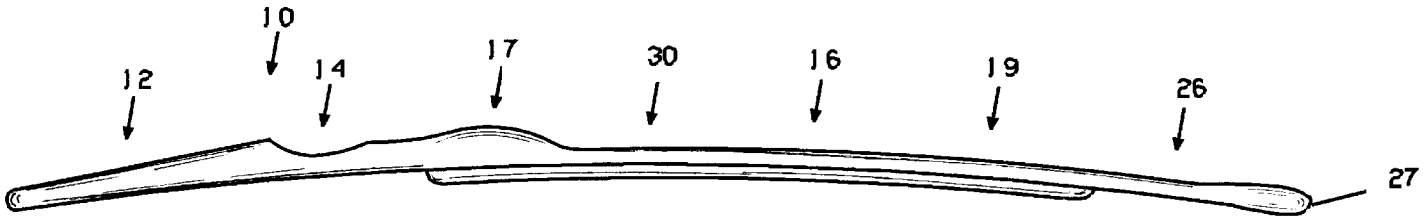
FIG. 2 is a side view of the paddle of FIG. 1.
Figure 2A:
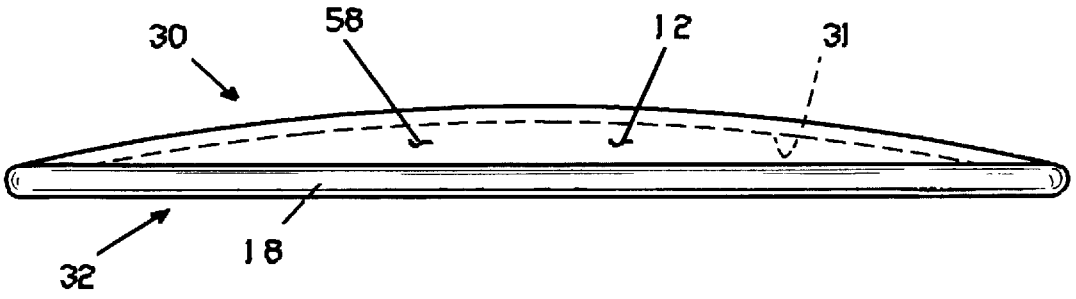
FIG. 2*a* is an end view of the paddle of the instant invention showing a dihedral curvature on the upper side of the paddle blade and a resulting spoon curvature (dashed lines) on an opposite side thereof.
Figure 2B:
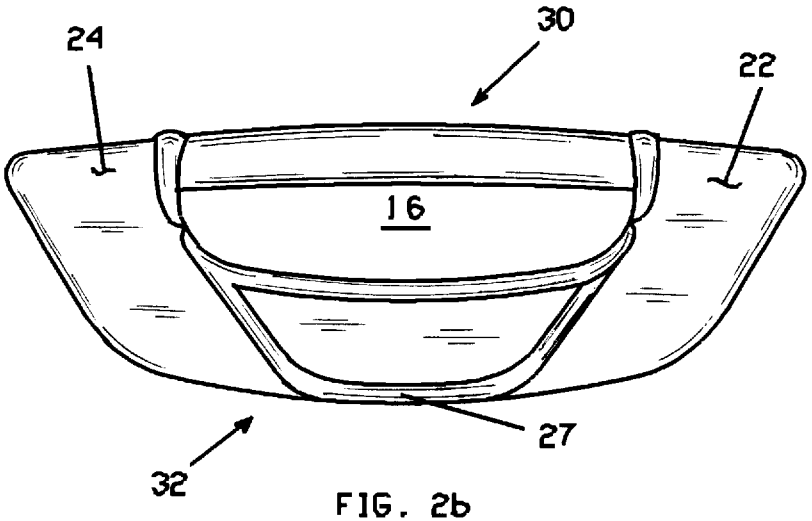
FIG. 2*b* is a view of the paddle of the instant invention as seen from an opposite end as shown in FIG. 2*a*.

Referring now to FIGS. 2, 2*a* and 2*b*, side and end views of paddle 10 are shown. Here, in FIG. 2, a side view, it is apparent that the paddle is of a curved configuration having an upper side 30 and a lower side 32. FIG. 2*a* shows a dihedral curvature extending laterally across upper side 30 of paddle blade 12, with dashed line 31 showing a spoon shaped curvature of side 32. FIG. 2*b* shows configuration of the paddle from end region 26. Constructed as such, when the hand is inserted through aperture 16 from side 32 and engaged with upper side 30 (dashed lines in FIG. 1), the paddle is of a configuration characteristic of a spoon paddle with a positive angle or rake. When the hand is inserted through aperture 16 from lower side 30 and engaged with side 32 of the paddle, the paddle is of a configuration characteristic of a dihedral paddle with a negative angle or rake.

End region 26 of paddle 10 includes a generally flat end member 27 of rounded and smooth contour on both sides 30 and 32 thereof. Additionally, member 27 is provided with raised, rounded and enlarged edges that do not dig into or chafe the skin of a user when used as either a spoon or dihedral paddle. As such, end region 26 and the adjacent regions 22*a* and 24*a* of supports 22 and 24, respectively, generally bear against the forearm near the inner region of an elbow of a user so that a lower side of end region 26 and an upper side of grip 17 cooperate to provide support for the wrist of a user, which otherwise would be bent backwards from the strain of using the paddle. This configuration and length of supports 22 and 24, in contrast to the prior art, has been found to support the wrist and provide leverage between the elbow and hand that is particularly advantageous when used for paddling a kayak. Additionally, swimming is greatly enhanced by effectively providing a paddle used in conjunction with the hand and entire forearm of a user, and which does not extend substantially beyond the reach of a user's hand.

Paddle 10 is provided with several raised or contoured regions to provide strength to the paddle and to assist in its use. On side 30 (FIG. 1), raised, curved regions 34 and 36 extend as shown from opposite sides of grip 17, and serve to reinforce the grip area on sides of the paddle between apertures 14 and 16. Additionally, raised regions 34 and 36 provide tactile indication to thumb 38 and little finger 40 of position of the paddle on the hand, and also offer areas of lateral engagement for these digits when the paddle is moved sideways. Rounded ridges 42, 44, and 46 around aperture 16 reinforce supports 22 and 24, and prevent chafing and irritation to the skin where these edges bear against portions of the arm and wrist of the user. A third rounded ridge 48 at the end of member 27 generally reinforces the end of member 27.

Figure 3:
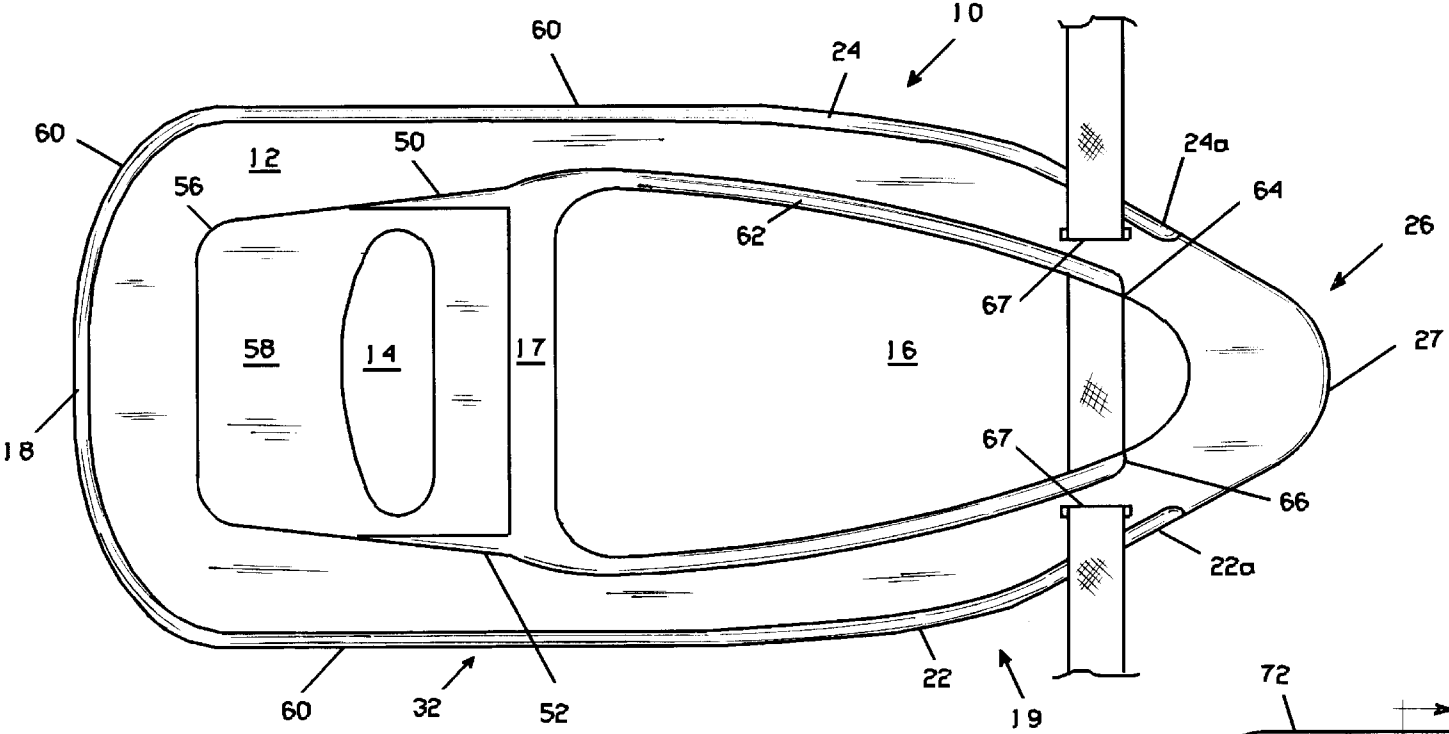
FIG. 3 is a bottom view of the paddle of the instant invention.

On side 32, (FIG. 3), raised areas 50 and 52 having a lateral rounded contour cooperate with raised regions 34 and 36 on side 30 to provide further reinforcement to the region around grip 17, which is somewhat narrower on side 32. Additionally, raised areas 50 and 52 define a portion of an outer periphery 56 of an area 58 depressed into side 32 and raised on side 30, as shown in FIG. 2*a*, which area 58 assisting in providing the spoon shape of side 32 and the dihedral shape of side 30. A raised, rounded ridge 60 extends around the periphery of paddle 10 on side 32, and provides reinforcement and abrasion resistance to the outer edges of paddle 10. Additionally, ridge 60 in the area of end 18 of paddle 10 assists the user to engage an object, such as a rock or portion of a tree, when the user wishes to pull himself/herself toward the shore. Further, the tactile indication and engagement of the thumb and little finger, as shown in FIG. 1, are provided by ridge 60 along edges of side 32 when the hand is engaged with the paddle in the manner shown in FIG. 1. As with side 30, a rounded ridge 62 extends from point 64 to point 66 around the periphery of aperture 16 to reinforce supports 22 and 24 and to provide enlarged regions to bear against the skin of the user. If necessary, slots 67 (not shown in FIG. 1) may be provided in regions 22*a* and 24*a* to receive a strap 69 (broken away) provided with an adjustable fastener, such as a conventional buckle or hook-and-loop tape, (not shown) for securing end 26 to the upper forearm region of the user.

Figure 4:
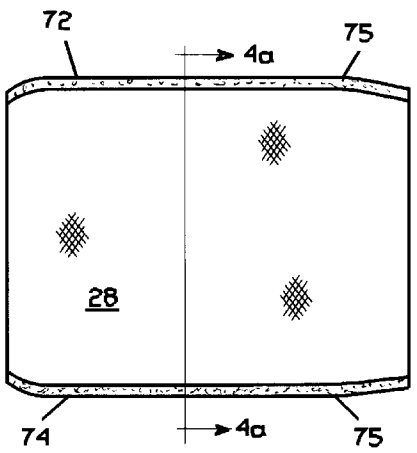
FIG. 4 is a top view of a cover for the paddle of the instant invention.
Figure 4A:
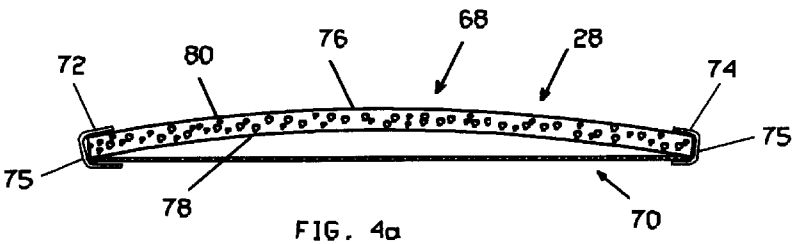
FIG. 4*a* is a sectional view of the cover taken along lines 4*a*—4*a* of FIG. 4.

Turning now to cover 28, and as shown in FIGS. 4 and 4*a*, this cover fits over and generally encloses an area of blade 12 and grip 17 as shown by the dashed line representation in FIG. 1, which encompasses the hand of the user generally up to the wrist. Both ends of cover 28 may be open so that water does not accumulate inside the cover. Cover 28 may be constructed at least on a side 68 (FIG. 4*a*) of an elastic, resilient, and durable material which covers the users hand and generally secures the paddle to the users hand, as shown in FIG. 1. The other side 70 of cover 28 may be constructed of a tough, strong durable material, such as a 600 dernier polyester duck which may be provided with a vinyl type coating. These two layers may be attached, as by sewing or bonding, at hems 72 and 74, where separate bindings 75 may be used to cover the interfaces between the material of sides 68 and 70 of cover 28. Alternately, cover 28 may be constructed simply as a sleeve fitted over paddle 10, or attached to or otherwise be constructed integral with the paddle. Additionally, a glove or glove-like structure which closely fits or grips the hand of a user may be attached to the described paddle, which then would be used as described in the foregoing. On the other hand, cover 28 may also be in the form of an elastic band or strap fixed to the paddle, which simply holds the paddle to the hand. While any material, such as a durable spandex type material, having the described properties may be used to construct side 68, a particular material, such as that used to construct wetsuits worn by divers, has been found to possess the additional advantage of providing thermal insulation to hands of the user. This becomes significant when using a kayak in a cold environment, where a danger of hypothermia is present. Here, the user typically would be wearing a waterproof or water resistant garment for protection against hypothermia caused by frigid waters, and sealed in the kayak by a skirt connected to the kayak opening and snugly fitted about the waist of the user. In this situation, the wetsuit material of side 68 is typically a layer of neoprene sponge 76 (FIG. 4*a*) covered on both sides by fabric layers 78 and 80, with the fabric layer 78 adjacent the skin being a soft, pliable fabric that will not chafe or otherwise irritate the skin when wet. The outer layer of fabric 80 of the wetsuit material is a fabric selected for durability, and particularly having wear and abrasion resistive properties. As such, when cover 28 is constructed of wetsuit material, fabric side 78 next to the hand will not chafe or otherwise irritate the skin when wet, and durable fabric layer 80 on the exterior of cover 28 provides wear and abrasion resistance. Thus, with the body of the user thermally protected as described, cover 28 provides thermal protection for the hands. Additionally, where a user encounters shallow, rapidly moving waters, additional protection for the hands is provided in the instance where the hands may impact stones and floating objects in the water.

In addition to the aforementioned thermal and impact protection afforded by cover 28 being constructed at least on one side of wetsuit material, the elasticity and flexibility of this material allows the user to simply extend his/her fingers along paddle blade portion 12, as described above, with cover 28 holding paddle 10 in place on the hand. Thus, if a user's hand becomes cramped or tired from holding grip region 17, or if the user otherwise prefers paddling with an open hand, he/she may simply extend the fingers along paddle blade 12 while using the paddle.

Another advantage of constructing at least one side of cover 28 of wetsuit material is that the foam material thereof increases buoyancy of the paddles to a point where they may keep a nonswimming person above water, providing an additional safety factor where an individual has become separated from a kayak. Additionally, where a conventional shaft type paddle is used, and where a kayaker overturns in the water and becomes separated from the kayak, the kayaker will typically also become separated from the paddle. Here, a kayaker may be forced to swim some distance in order to retrieve both the paddle and the kayak. With Applicants paddle and associated cover, when the kayaker and kayak become separated, the paddles remain fixed to the users hands, which then serve as a swim aid so that the user may more quickly retrieve the kayak without having to also retrieve a loose paddle.

Having thus described my invention and the manner of its use, it is apparent that incidental modifications may be made thereto that fairly fall within the scope of the following appended claims, wherein I claim:

I claim:

1. A hand paddle comprising:

a paddle blade of a length shorter than its width and having an upper side and a lower side, an extended-in-length brace extending from said saddle blade, said brace having elongated side regions defining an open area therebetween for generally lengthwise accommodation of a forearm of a user between said side regions, said side regions terminating at an opposite end of said paddle at a generally flattened end region having corresponding upper and lower sides as said paddle blade for bearing against a forearm of a user at a point near an elbow thereof, an elongated opening extending laterally across said paddle blade forming a grip between said elongated opening and a rearward portion of said paddle blade so that the hand paddle may be gripped by a user, whereby in use said upper side of said paddle blade bears against a hand of a the user, a forearm of a user is positioned generally lengthwise between said two side regions of said brace and a lower side of said end region bears against a forearm of a user near an elbow thereof.

2. A paddle as set forth in claim 1 wherein said paddle is configured so that when used in one direction the paddle is a spoon paddle with a positive rake and when reversed said paddle is a dihedral paddle with a negative rake.

3. A paddle as set forth in claim 1 further comprising a cover fitted over at least a portion of said paddle blade, said cover constructed to hold said paddle to a hand of a user so that a user need not grip said paddle during use.

4. A paddle as set forth in claim 3 wherein said cover includes one side constructed of an elastic material, for holding said paddle to said users hand.

5. A paddle as set forth in claim 4 wherein said elastic material includes a layer of sponge material to thermally insulate and physically protect a hand of a user.

6. A paddle as set forth in claim 3 wherein said cover is open at both ends to prevent water from accumulating inside said cover.

7. A hand and forearm paddle comprising:

a paddle blade extending approximately over an area encompassed by a hand of a user;

pair of supports extending rearward from said paddle blade lengthwise along opposed sides of a forearm of a user, said supports terminating at an end region opposed from said paddle blade, said end region adapted for bearing against a forearm of a user near an elbow thereof, an open region defined by sides of said support, so that a hand of a user is positionable on one side of said paddle blade, a forearm of a user is positionable generally lengthwise between said Pair of supports and said end region is positionable near an elbow on an opposite side of said paddle, providing leverage between an elbow and hand of a user, and protective securing means extending over said paddle blade for holding said paddle blade to a hand and protecting a hand of a user.

8. A paddle as set forth in claim 7 wherein said paddle is configured on one side as a dihedral paddle, and is configured on an opposite side as a spoon paddle.

9. A paddle as set forth in claim 7 wherein said securing means comprises a cover associated with said paddle blade and extending substantially over a hand of a user.

10. A paddle blade as set forth in claim 9 wherein said cover is of a construction including a resilient, elastic foam material.

11. A paddle blade as set forth in claim 10 wherein said cover is constructed of wetsuit material.

12. A hand held paddle comprising:

a paddle blade of a length shorter than its width and having an upper side and a lower side, an extended-in-length brace having corresponding upper and lower sides as said paddle, with a generally flattened end opposed from said paddle blade for bearing against a forearm of a user at a point near an elbow thereof, a first opening in said brace for receiving a hand of a user, a second opening forward of said first opening, with a region between said first and second openings forming a grip for said paddle, a cover fitted over a portion of said first opening, said grip, said second opening and a major portion of said paddle blade, said cover constructed to hold said paddle to a hand of a user so that a user need not grip said paddle during use.

13. A hand paddle comprising:

a paddle blade of a length shorter than its width and having a first side and a second side, an extended-in-length brace extending from a rearward region of said paddle blade, said brace having elongated side regions defining an open area therebetween for generally lengthwise accommodation of a forearm of a user between said side regions, said side regions terminating at an opposite end of said paddle at a generally flattened end region having corresponding first and second sides as said paddle blade so that one or the other of said corresponding first and second sides of said end region may bear against a forearm of a user at a point near an elbow thereof, said hand paddle having a curvature from end-to-end so that with a hand bearing against said first side of said paddle blade said paddle has a positive rake and with a hand bearing against said second side of said paddle blade said paddle has a negative rake, whereby in use one of said first side and said second side of said paddle blade bears against a hand of a user, a forearm of a user is positioned generally lengthwise between said side regions of said brace and an opposite one of said corresponding first side and said second side of said end region with respect to said paddle blade bears against a forearm of a user near an elbow thereof.

14. A hand paddle as set forth in claim 13 further comprising a grip formed between a rearward edge of an opening extending across said paddle blade and a rearward portion of said paddle blade.

15. A hand paddle as set forth in claim 13 further comprising a cover extending over said paddle blade, said cover protecting a hand of a user and holding a hand of a user to said paddle blade.

* * * * *